US005971779A

United States Patent [19]

Okabe

[11] Patent Number: 5,971,779

[45] Date of Patent: Oct. 26, 1999

[54] CONNECTOR HAVING A CAN LEVER WITH AN ELECTRIC WIRE PROTECTING WALL

[75] Inventor: Toshiaki Okabe, Shizuoka, Japan

[73] Assignee: Yazaki Corporation, Tokyo, Japan

[21] Appl. No.: 09/108,180

[22] Filed: Jul. 1, 1998

[30] Foreign Application Priority Data

Jul. 1, 1997 [JP] Japan ..... 9-175848

[51] Int. Cl.[6] ..... H01R 13/62

[52] U.S. Cl. ..... 439/157

[58] Field of Search ..... 439/157, 153, 439/372

[56] References Cited

U.S. PATENT DOCUMENTS

| | | | |
|---|---|---|---|
| 4,981,440 | 1/1991 | Werner et al. | 439/266 |
| 5,172,998 | 12/1992 | Hatagishi | 403/27 |
| 5,431,573 | 7/1995 | Endo et al. | 439/157 |
| 5,711,682 | 1/1998 | Maejima | 439/157 |

FOREIGN PATENT DOCUMENTS

| | | | |
|---|---|---|---|
| 5-182716 | 7/1993 | Japan | H01R 13/629 |
| 6-68933 | 3/1994 | Japan | H01R 13/629 |
| 6-251826 | 9/1994 | Japan | H01R 13/629 |
| 6-302353 | 10/1994 | Japan | H01R 13/629 |

*Primary Examiner*—Khiem Nguyen
*Assistant Examiner*—Michael C. Zarroli
*Attorney, Agent, or Firm*—Sughrue, Mion, Zinn, Macpeak & Seas, PLLC

[57] ABSTRACT

An electric, wire protecting wall 37*a* is formed on a lever 26 which is rotatably attached to a connector body 24 of a male connector 25, so that, under provisional fixing and complete fixing states, the connector body 24 and the lever 26 protect portions in the vicinity of connections of electric wires L which are attached to a rear end side of the connector body 24. According to this configuration, even when the electric wires are packed, transported, or laid under a state where the male connector 25 is attached to the electric wires, the electric wires can be prevented from being damaged.

5 Claims, 6 Drawing Sheets

CONNECTOR HAVING A CAN LEVER WITH AN ELECTRIC WIRE PROTECTING WALL

BACKGROUND OF THE INVENTION

1. Field of the Invention

The invention relates to a lever fitting-type connector in which fitting of male and female connectors is easily performed by operating a lever.

2. Related Art

FIG. 7 shows a frame-coupling type connector 1 which is disclosed in Unexamined Japanese patent publication HEI 6-251826. The connector 1 includes: a female connector section 3 which is disposed on a connection box body 2 such as an electric connection box; male connectors 5 which are to be inserted and fitted into a hood portion 4 of the female connector section 3; and a frame 6 which causes the male connectors 5 to be inserted and fitted into the female connector section 3. As shown in FIGS. 7 and 8, a plurality of electric wires 13 are connected to the male connectors 5, and drawn out from the rear end sides of the male connectors 5. Although FIG. 7 shows that the electric wires 13 are connected to only one of the male connectors 5, the electric wires 13 in an actual connector are connected to both the male connectors 5. The frame 6 consists of a body 7 in which the male connector 5 is rotatably accommodated, a rotation leg 8 which protrudes from one end of the body 7, and an operating projection 9 which projects from the other end. A sliding shaft 10 is formed at the tip end portion of the rotation leg 8. The sliding shaft 10 is inserted into and engagingly held to a slide groove 12 of a frame support 11 which is disposed in the periphery of the female connector section 3.

As shown in FIG. 8, the sliding shaft 10 is engagingly held in the slide groove 12, and the operating projection 9 is pressed so that the frame 6 is rotated in the direction of the arrow a about the sliding shaft 10, whereby the male connector 5 is inserted and fitted into the female connector section 3. When the male connector 5 is to be extracted from the state where it is fitted into the female connector section 3, the operating projection 9 is pressed in the reverse direction so that the frame 6 is rotated in the direction opposite to that of the arrow a, whereby the male connector 5 is extracted from the hood portion 4 of the female connector section 3.

In this case, the sliding shaft 10 functions as the fulcrum, and the operating projection 9 as the point of force, so that the supporting portion where the male connector 5 is rotatably supported on the frame 6 serves as the point of action, thereby enabling the male connector 5 to be fitted into the female connector section 3 with a small force. Therefore, the operating force to be exerted when the male connector 5 is fitted into the female connector section 3 can be reduced.

In the frame-coupling type connector 1, as shown in FIGS. 7 and 8, the electric wires 13 are drawn out from the rear end sides of the male connectors 5, and the electric wires 13 drawn out from the male connectors 5 are not protected by any means. When a wire harness to which the male connectors 5 are attached is packed or transported, or when an operation of laying the electric wires is conducted, there is a fear that the electric wires 13 are damaged.

SUMMARY OF THE INVENTION

It is an object of the invention to provide a lever fitting-type connector in which, under a state where provisional fixing or fitting of a lever is attained, electric wires can be prevented from being damaged, and the lever can be surely operated.

In order to attain the object, according to a first aspect of the present invention, there is provided a lever fitting-type connector comprising: a female connector section having a hood portion which is disposed integrally with a housing portion in which one or more terminals are accommodated; a male connector having a connector body in which one or more counter terminals to be respectively connected with the terminals are accommodated and one or more electric wires connected at an end with the counter terminals are drawn out from a rear end side, and which is fitted into the hood portion; and a lever which is rotatably attached to the male connector and which causes the connector body to be inserted and fitted into the hood portion, wherein the lever is provided with an electric wire protecting wall which covers the electric wires drawn out from the rear end side of the connector body.

In the lever fitting-type connector, the connector body of the male connector can be fitted into the hood portion of the female connector section by operating the lever attached to the male connector. In the lever, the electric wire protecting wall is formed so as to cover the electric wires drawn out from the rear end side. Therefore, when electric wires to which the male connector is attached are packed, transported, or laid, for example, the electric wires protecting wall can prevent the electric wires (particularly, the portions locating in the vicinity of the connector body) from being damaged.

According to a second aspect of the present invention, the lever includes: a lever body having a pair of lever walls which are rotatably supported on faces of side walls of the connector body, respectively; a projection which is disposed at one side of each of the lever walls, and which is engagingly held to the hood portion; and an operating portion which is disposed at another side and formed so as to couple the lever walls with each other, and which causes the lever body to be rotated about a portion where the lever body is supported, thereby fitting the connector body into the hood portion, and the electric wire protecting wall extends from the operating portion so as to couple the lever walls with each other.

In the lever fitting-type connector, the connector body of the male connector can be easily fitted into the hood portion of the female connector section by operating the operating portion of the lever which is rotatably supported on the side walls of the connector body. Since the electric wire protecting wall is bridged between the lever walls so as to couple the walls with each other, the lever can be rotated by operating the electric wire protecting wall.

According to a third aspect of the present invention, under a state where the male connector is completely fitted into the hood portion of the female connector section, an electric wire housing space which accommodates the electric wires is formed between the electric wire protecting wall of the lever and the connector body.

In the lever fitting-type connector, even when the male connector is completely fitted into the female connector section, the electric wires can be accommodated in the electric wire housing space between the connector body and the electric wire protecting wall. Therefore, the electric wires are prevented from being excessively bent, and can be protected more effectively.

According to a fourth aspect of the present invention, the connector further includes provisional fixing means for provisionally fixing the connector body at a position where the connector body is not yet completely fitted into the hood portion, and, under the provisional fixing state, the electric wires are accommodated between the electric wire protecting wall and the connector body.

In the lever fitting-type connector, since the lever body is provisionally fixed at the provisional fixing position of the connector body, the lever does not impede the operation of inserting the connector body into the hood portion. Furthermore, the electric wire protecting wall covers the electric wires under a state where the lever body is provisionally fixed, and hence the electric wires can be protected. When a wire harness to which the male connector is attached is packed or transported, or when an operation of laying the electric wires is conducted, particularly, the electric wires are shielded from an external load, because the electric wires are positioned between the electric wire protecting wall and the connector body.

According to a fifth aspect of the present invention, the connector further includes a provisional fixing protrusion which protrudes from the connector body, and a provisional fixing hole which is formed in the lever body, the provisional fixing protrusion being inserted into and engagingly held by the provisional fixing hole.

In the lever fitting-type connector, when the lever body is rotated to the provisional fixing position with respect to the connector body, the provisional fixing protrusion of the connector body is inserted into and engagingly held by the provisional fixing hole of the lever body and the lever body is held at the provisional fixing position of the connector body.

DETAILED DESCRIPTION OF THE PREFERRED EMBODIMENTS

Hereinafter, the lever fitting-type connector of the invention will be described in detail with reference to the accompanying drawings showing embodiments.

Figure 1:
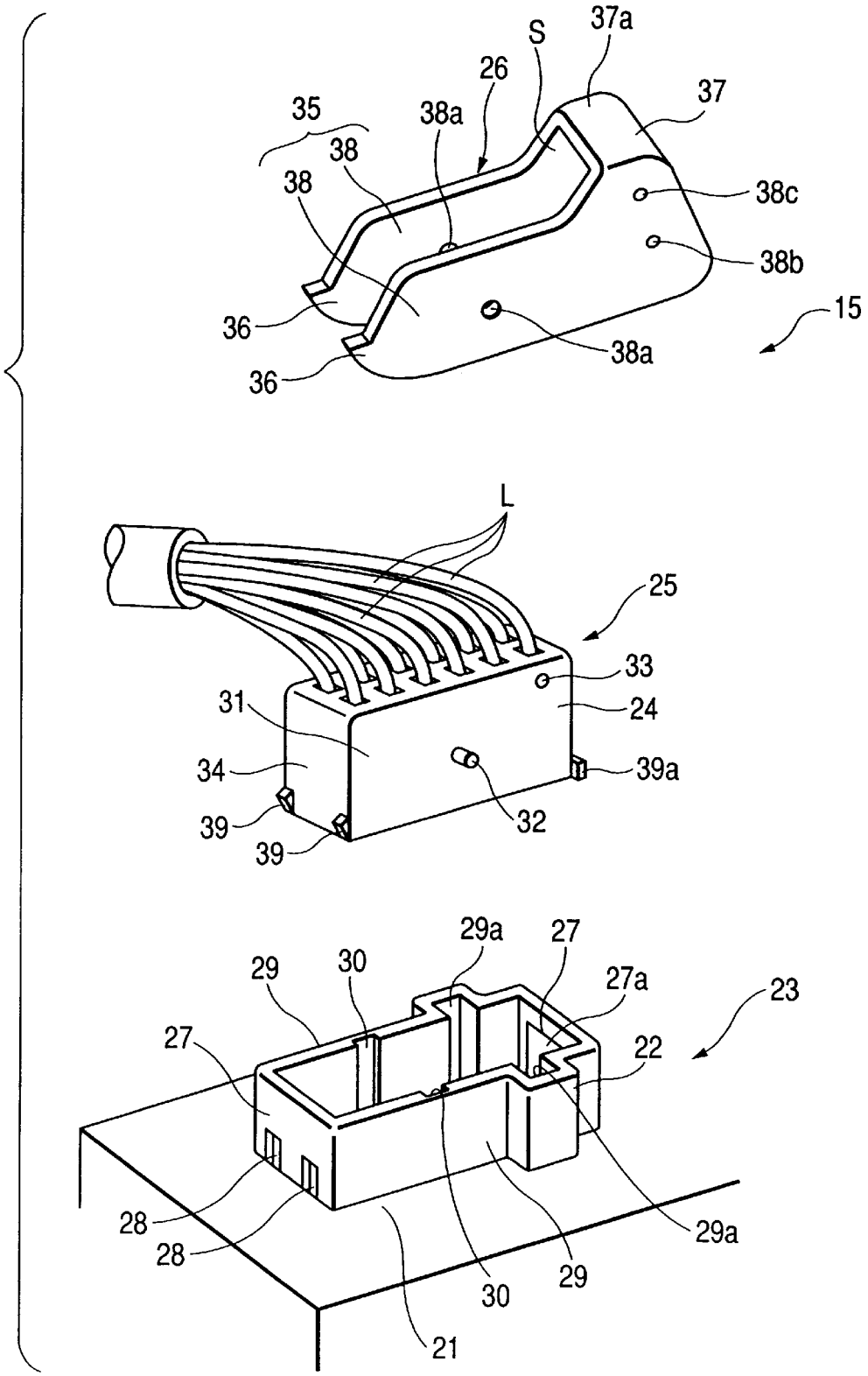
FIG. 1 is an exploded perspective view showing an embodiment of the connector of the invention.

A lever fitting-type connector (hereinafter, referred to as "connector") 15 of a first embodiment shown in FIGS. 1 to 6 will be described. The connector 15 is used in an upper cover 17 of an electric connection box 16 shown in FIG. 2, and for connecting bus bars 20 on circuit boards 19 stacked between the upper cover 17 and a lower cover 18, with terminal portions of a wire harness. As shown in FIGS. 1 and 3, the connector 15 comprises: a female connector section 23 in which a hood portion 22 is formed integrally with a housing portion 21 of the upper cover 17; a male connector 25 having a connector body 24 which is to be inserted and fitted into the hood portion 22 of the female connector section 23; and a lever 26 which is disposed on the outside of the connector body 24 of the male connector 25 and which causes the connector body 24 to be inserted and fitted into the hood portion 22 of the female connector section 23.

Figure 2:
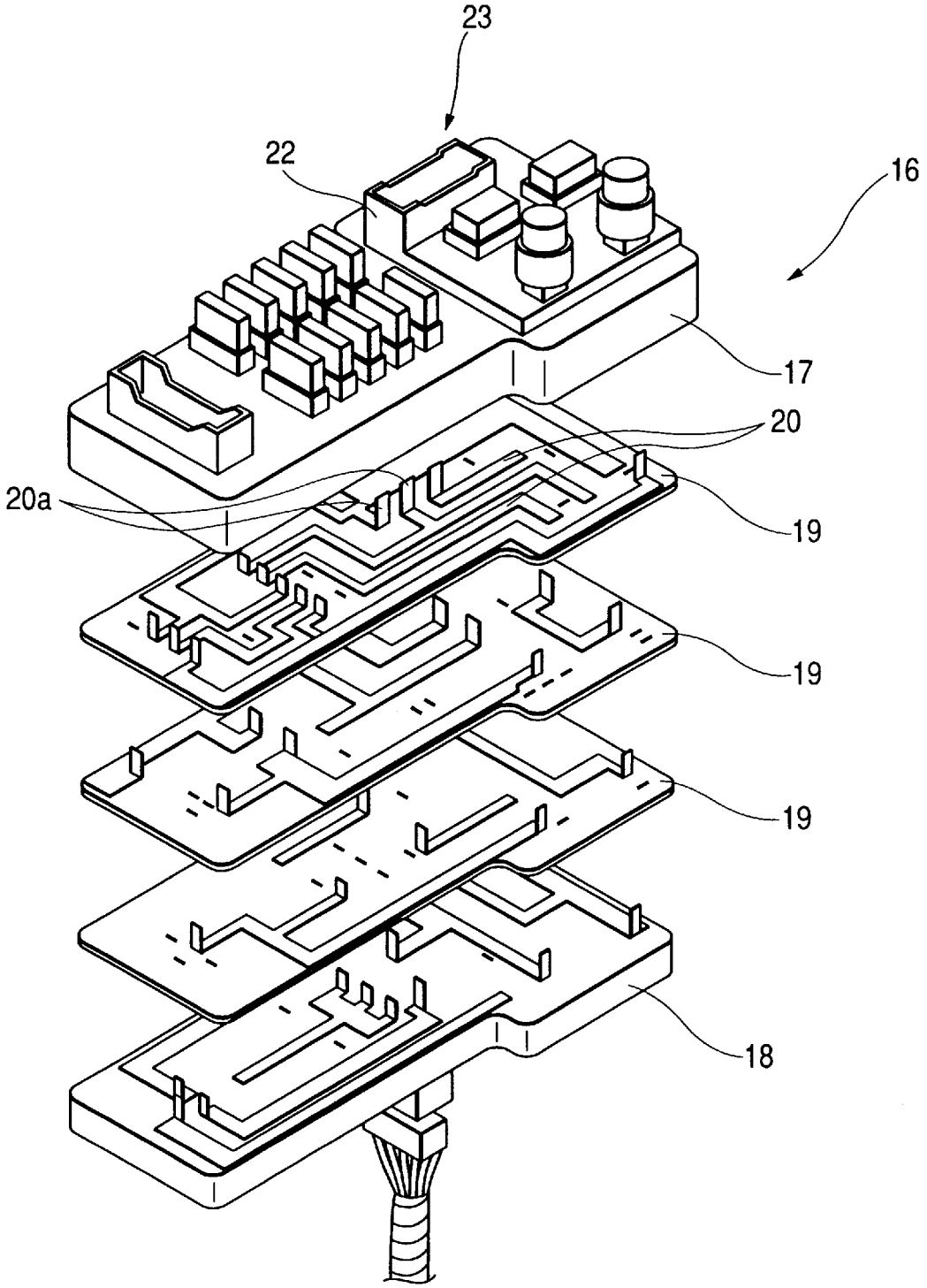
FIG. 2 is an exploded perspective view showing the structure of a female connector section in the above embodiment.
Figure 3:
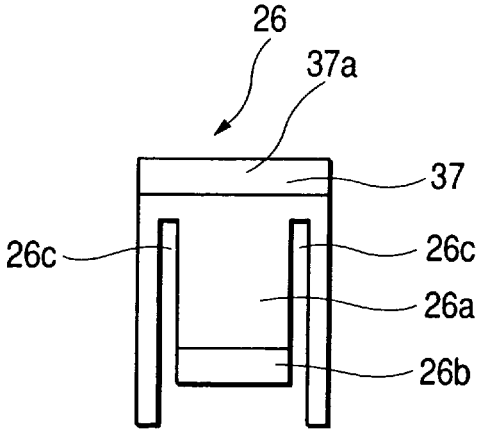
FIG. 3 is a front view of the lever in the above embodiment.

As shown in FIG. 2, in the female connector section 23, terminal portions of the bus bars 20 are accommodated in the housing portion 21, and male terminals 20*a* of the terminal portions project into the hood portion 22. As shown in FIG. 1, in the hood portion 22, two cutaway portions 28 through which the interior and exterior of the hood portion communicate with each other are formed in a wall 27 on one side. An engaging hole 27*a* into which an engaging projection 26*b* formed integrally with the lever 26 (described later) enters to be engagingly held thereto is formed in a wall 27 on the other side. Grooves 30 which elongate in the fitting direction of the connector body 24 are formed at middle portions of a pair of opposing walls 29 which cooperate with the walls 27 to constitute the hood portion 22, respectively. Guide grooves 29*a* are formed in the walls 29. Guide ribs 39*a* projecting from the lower sides of a side wall 34 on the other side of the connector body 24 which will be described later are guided by the guide grooves. The connector body 24 of the male connector 25 is inserted into the thus configured hood portion 22 and female terminals (not shown) accommodated in the connector body 24 are electrically contacted with the male terminals 20*a*.

The male connector 25 has a plurality of terminal chambers disposed in the connector body 24. The female terminals are accommodated in the terminal chambers, respectively. The counter male terminals 20*a* are to be inserted into the terminal chambers from one end side (the lower side in the figure), and electric wires L which are connected at ends to the female terminals are drawn out from the other end side (the upper side in the figure). A column-like boss 32 projects from a center portion of each of the side walls 31 (in FIG. 1, only one of the side walls is shown) of the connector body 24. A positioning protrusion 33 which serves as the provisional fixing protrusion and which is smaller than the bosses 32 protrudes from a position which is at the upper and right side in FIG. 1 with respect to the corresponding boss 32. The bosses 32 are respectively inserted into rotation holes 38*a* formed in lever walls 38 which will be described later. Tip end portions of the bosses projecting from the rotation holes 38*a* are inserted into the grooves 30 disposed in the hood portion 22 as described above. The positioning protrusions 33 are inserted into and engagingly held to provisional fixing holes 38*b* serving as the provisional fixing holes and engaging holes 38*c* which are formed in the lever walls 38 as described later.

Furthermore, a provisional fixing protrusion 39 protrudes from side ends of each of side walls 34 of the connector body 24, on the side of fitting faces. When the connector body 24 is inserted into the hood portion 22 (before the fitting by means of the lever is done), the provisional fixing protrusions 39 are inserted into and engagingly held to the cutaway portions 28 of the hood portion 22, so as to provisionally hold the connector body 24 to the provisional fixing state with respect to the hood portion 22. The lever 26 is disposed on the outside of the connector body 24.

The lever 26 consists of: a lever body 35 which is rotatably supported on the connector body 24 of the male connector 25 and which consists of the pair of opposing lever walls 38; projections 36 which are formed at one end of the lever body 35, and which, when the connector body 24 is fitted into the hood portion 22, are engagingly held to the hood portion 22; an operating portion 37 which is disposed at the other side and which causes the lever body 35 to be rotated about the portions where the projections 36 are engagingly held to the hood portion 22, thereby fitting the connector body 24 into the hood portion 22; and an electric wire protecting wall 37*a* which is bridged between the upper portions of the lever walls 38 and which elongates from the operating portion 37. The lever walls 38 have a shape in which the other side portion upward expands. The electric wire protecting wall 37*a* is formed so as to couple the upper edges of the expanded portions with each other. The rotation holes 38*a* into which the bosses 32 formed on the connector body 24 are rotatably fitted are formed at center portions of the lever walls 38. The provisional fixing holes 38*b* into which the positioning protrusions 33 formed on the connector body 24 are inserted under the provisional fixing state, and the engaging holes 38*c* which are located so as to be slightly higher than the provisional fixing holes 38*b* and into which the positioning protrusions 33 are inserted under the complete fixing state are formed in the other side portions of the lever walls 38. In the other side face of the lever 26, as shown in FIG. 3, a lock piece 26*a* hanging from the lower portion of the operating portion 37 is formed integrally with the operating portion 37. The engaging projection 26*b* which is to be engagingly held to the engaging hole 27*a* of the hood portion 22 projects from the lower portion of the lock piece 26*a*. In the figure, 26*c* designates slits which are formed on both the side of the lock piece 26*a*.

Figure 4:
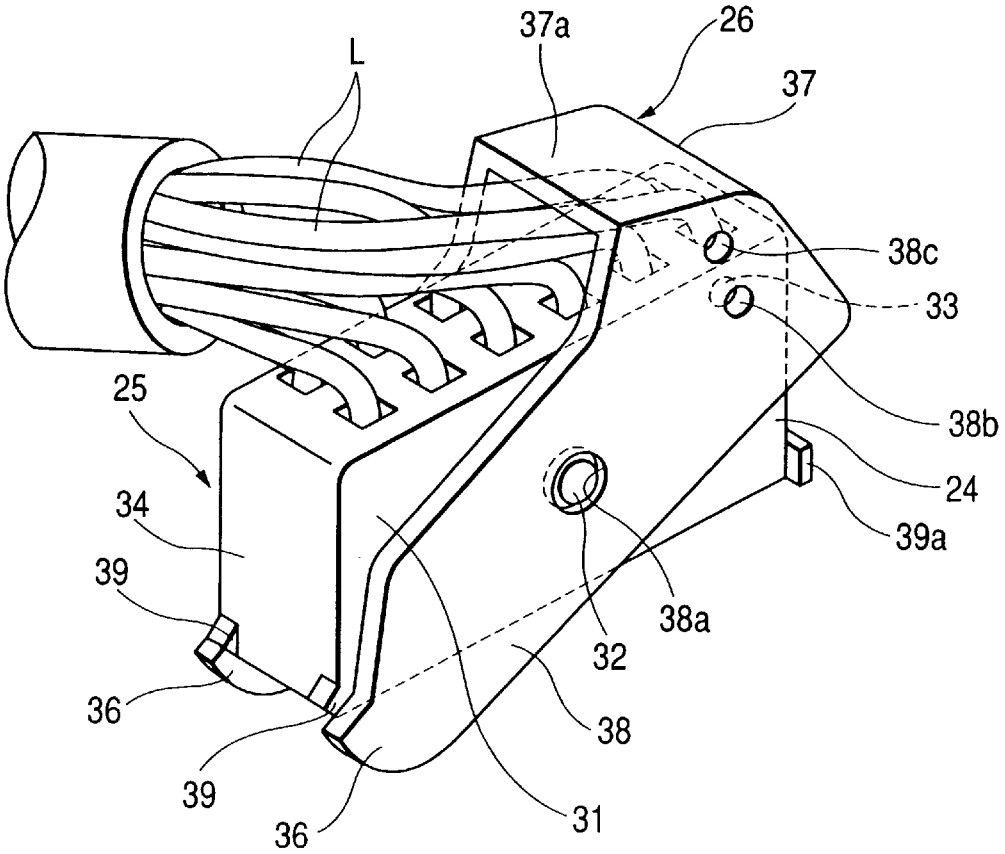
FIG. 4 is a perspective view showing a provisional fixing state of the connector of the above embodiment.

FIG. 4 shows the provisional fixing state in the embodiment in which the lever 26 is attached to the connector body 24 and the positioning protrusions 33 are inserted into and engagingly held to the provisional fixing holes 38*b*. Usually, a wire harness is packed or transported and an operation of laying electric wires at the cite is conducted under a state where the lever 26 is provisionally fixed to the connector body 24 to which ends of the electric wires L are connected. In the embodiment, under the provisional fixing state, a space which accommodates the electric wires L is provided between the electric wire protecting wall 37*a* formed in the lever 26 and an electric wire mounting face of the connector body 24, and the electric wires L are prevented from being excessively bent. Even when a wire harness is packed or transported and an operation of laying electric wires at the cite is conducted under this state, the electric wires L are protected by the electric wire protecting wall 37*a*, and hence the electric wires L are prevented from being damaged.

Figure 5A:
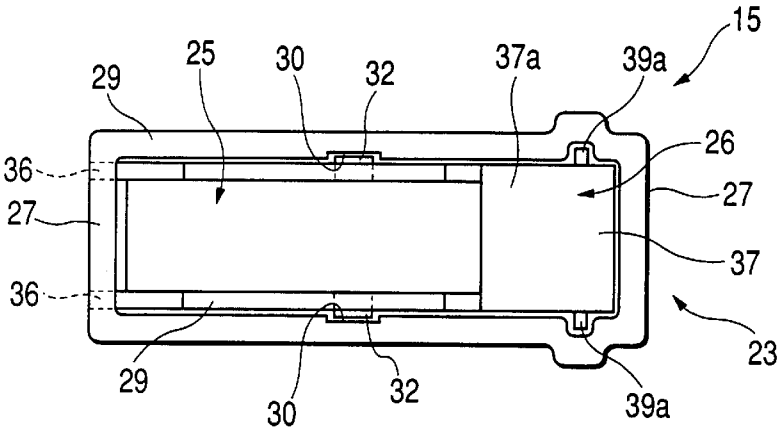
FIG. 5(*a*) is a plan view showing a complete fixing state of the connector of the embodiment, FIG. 5(*b*) is a side view, and FIG. 5(*c*) is a left side view.
Figure 5B:
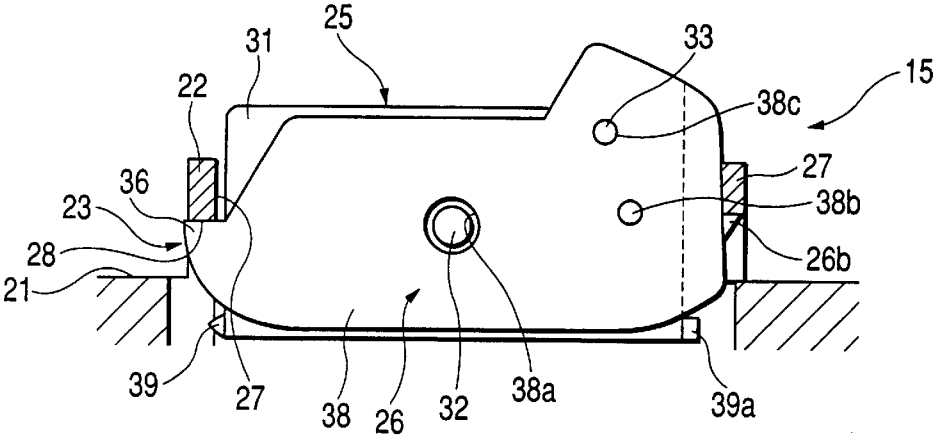
Figure 5C:
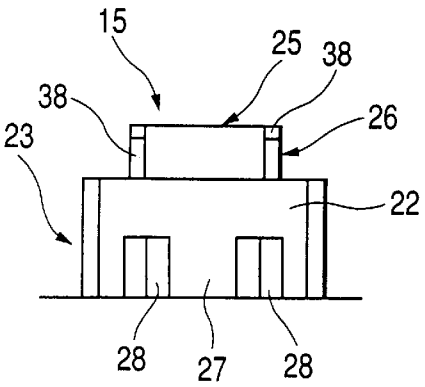

FIGS. 5(*a*), 5(*b*), and 5(*c*) show a state where the male connector 25 is completely fitted into the hood portion 22 of the female connector section 23. As shown in the figures, the lever body 35 and the lock piece 26*a* of the lever 26 are inside the hood portion 22 under a state where the connector body 24 is fitted into the hood portion 22. As described above, the lever body 35 consists of the pair of thin plate-like lever walls 38 which are rotatably supported on wall faces of the side walls 31 of the connector body 24, respectively. Each of the projections 36 is disposed at one side of the corresponding lever wall 38. The operating portion 37 is formed by coupling the other sides of the pair of lever walls 38 with each other. The rotation holes 38*a* are formed at substantially center portions of the lever walls 38, respectively. The bosses 32 are inserted into the rotation holes 38*a*, thereby allowing the lever walls 38 to be rotated on the wall faces of the side walls 31 of the connector body 24. The positioning holes 38*b* are formed in the leverwalls 38, on the side of the operating portion 37. The positioning protrusions 33 protruding from the side walls 31 of the connector body 24 are inserted into and engagingly held to the positioning holes 38*b*, so that the lever body 35 is held at a provisional fixing position with respect to the connector body 24. The positioning protrusions 33 and the positioning holes 38*b* constitute the provisional fixing means. Under a state where the connector body 24 is completely fitted into the hood portion 22, as shown in FIG. 5(*a*), the lever walls 38 are interposed between the inner walls 29 of the hood portion 22 and the side walls 31 of the connector body 24. Therefore, the lever 26 does not protrude outside from the female connector section 23, and hence the connector can be miniaturized as a whole. Furthermore, the lever body 35 is positioned inside the hood portion 22. Even when the lever body 35 is bent toward the outside of the connector body 24, therefore, the lever body is blocked by the inner wall of the hood portion 22, so that the lever body 35 is prevented from being disengaged from the connector body 24.

Next, the procedure of fitting the male connector 25 into the female connector section 23 in the connector of the embodiment will be described.

Figure 6A:
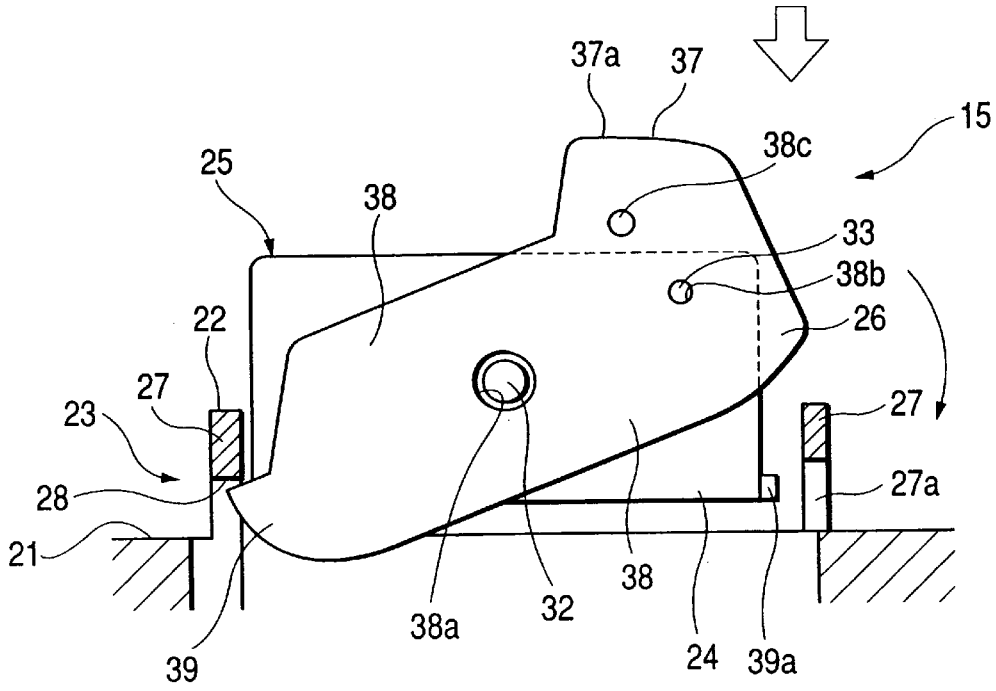
FIGS. 6(*a*) and 6(*b*) are side views showing a fitting method in the connector of the embodiment.
Figure 6B:
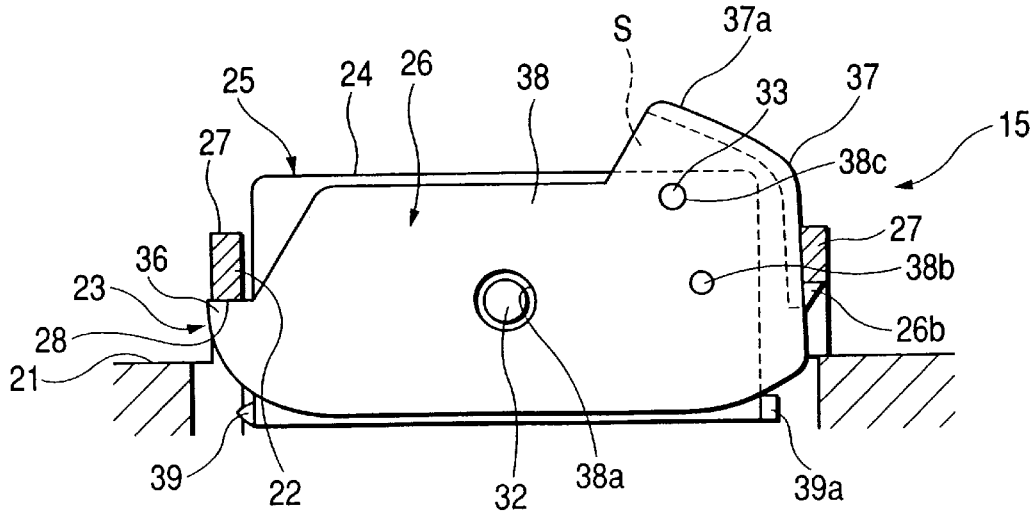
Figure 7:
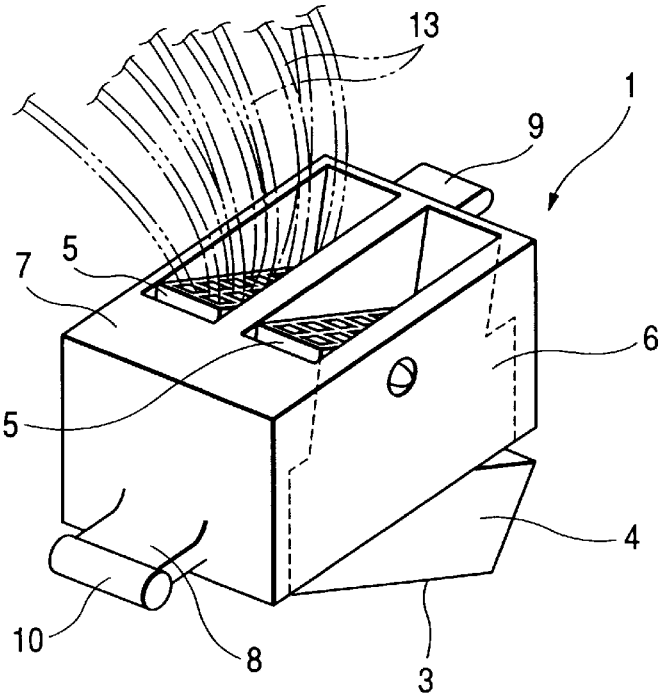
FIG. 7 is a perspective view showing a connector of the prior art.
Figure 8:
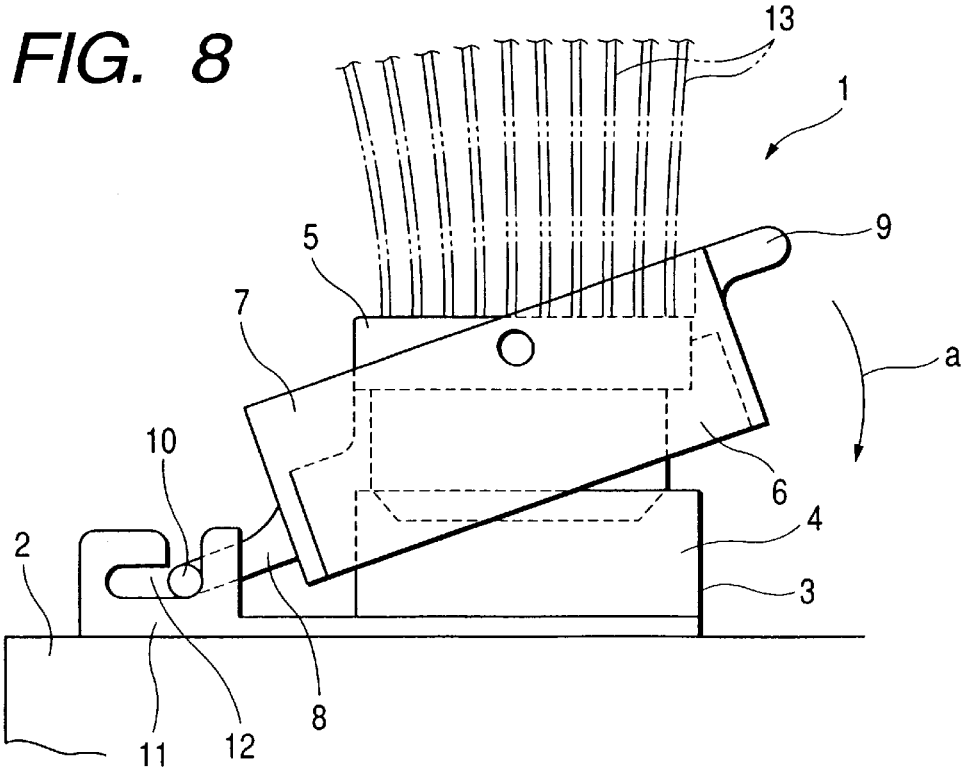
FIG. 8 is a side view showing the connector of the prior art.

Under a state where the positioning protrusions 33 are inserted into and engagingly held to the positioning holes 38*b* and the lever 26 is provisionally fixed at the provisional fixing position of the connector body 24, as shown in FIG. 6(*a*), the connector body 24 is inserted into the hood portion 22. Under this state, the terminals of the female connector section 23 are not connected with those of the male connector 25.

When the connector body 24 is then inserted into the hood portion 22, the provisional fixing protrusions 39 of the connector body 24 are engagingly held to the cutaway portions 28, and the projections 36 of the lever 26 are inserted into and engagingly held to the cutaway portions 28. As shown in FIG. 6(*a*), the lever 26 is rotated about the portions where the projections 36 are inserted into and engagingly held to the cutaway portions 28, by operating the operating portion 37. When the lever 26 is rotated, the connector body 24 is inserted into the inner portion of the hood portion 22 and finally completely fitted into the hood portion 22 as shown in FIG. 6(*b*) and the terminals of the female connector section 23 are connected with those of the male connector 25. At this time, the positioning protrusions 33 are inserted into and engagingly held to the engaging holes 38*c* formed in the lever walls 38, and the engaging projection 26*b* of the lock piece 26*a* is inserted into and engagingly held to the engaging hole 27*a* formed in the hood portion 22. In the embodiment, even when the male connector 25 is completely fitted into the female connector section 23, as shown in FIG. 6(*b*) , a spaces which accommodates the electric wires L can be formed between the electric wire protecting wall 37*a* and the electric wire mounting face of the connector body 24. Therefore, the electric wires L are prevented from being excessively bent, and protected by the electric wire protecting wall 37*a*. When the male connector 25 is to be disengaged from the hood portion 22, the engaging projection 26*b* is pushed toward the inside of the hood portion 22 so as to be disengaged from the engaging hole 27*a*, and, under this state, the lever 26 is rotated in the direction opposite to that in the above-described case, thereby canceling the fitting.

In the above, the embodiment of the invention has been described. The invention is not restricted to the embodiment, and various modifications included into the summary of the configuration are enabled. In the embodiment described above, the provisional fixing means is configured by the positioning protrusions 33 and the positioning holes 38*b*. The engagingly holding structure is not restricted to this as far as a temporal holding is attained.

As described above, according to the present invention, the electric wire protecting wall is formed on the lever so as to cover the electric wires drawn out from the rear end side. Therefore, the invention can attain an effect that, when electric wires to which the male connector is attached are packed, transported, or laid, for example, the electric wires protecting wall can prevent the electric wires (particularly, the portions locating in the vicinity of the connector body) from being damaged.

According to the present invention, since the electric wire protecting wall is bridged so as to couple the lever walls with each other and elongates from the operating portion, the lever can be rotated also by operating the electric wire protecting wall, thereby attaining an effect that the substantial operation area of the operating portion can be increased.

According to the present invention, even when the male connector is completely fitted into the female connector section, the electric wires can be accommodated in the electric wire housing space between the connector body and the electric wire protecting wall. Therefore, the invention can attain an effect that the electric wires are prevented from being excessively bent and can be protected more effectively.

According to the present invention, since the lever body is provisionally fixed at the provisional fixing position of the connector body, the lever does not impede the operation of inserting the connector body into the hood portion. Furthermore, the electric wire protecting wall covers the electric wires under a state where the lever body is provisionally fixed, thereby attaining an effect that the electric wires can be protected. When a wire harness to which the male connector is attached is packed or transported, or when an operation of laying electric wires is conducted, particularly, the provisional fixing of the lever body enables a space which accommodates the electric wires to be ensured between the electric wire protecting wall and the connector body, and the electric wires to be protected by the electric wire protecting wall. Therefore, the invention attains an effect that the electric wires are prevented from being subjected to an external load.

According to the present invention, the lever body can be engagingly held at the provisional fixing position with respect to the connector body. Therefore, the invention can attain an effect that, under a state where the male connector is not fitted into the female connector section, the lever body can be held so that the electric wire protecting wall formed on the lever covers the electric wires and the electric wires can be protected.

What is claimed is:

1. A lever fitting-type connector comprising:

a female connector section having a hood portion which is disposed integrally with a housing portion for accommodating terminals;

a male connector having a connector body for accommodating mating terminals to be respectively connected with said terminals, and electric wires connected at an end with said mating terminals drawn out from a rear end side, and said connector body being fitted into said hood portion; and a lever rotatably attached to said male connector and which causes said connector body to be inserted and fitted into said hood portion, said lever including an electric wire protecting wall which covers the electric wires drawn out from said rear end side of said connector body.

2. A lever fitting-type connector according to claim 1, wherein said lever includes:

a lever body having a pair of lever walls which are rotatably supported on faces of side walls of said connector body, respectively; and a projection disposed at one side of each of said lever walls, and engagingly held to said hood portion; and an operating portion disposed at another side and formed so as to couple said lever walls with each other, and which causes said lever body to be rotated about a portion where said lever body is supported, to fit said connector body into said hood portion, wherein said electric wire protecting wall elongates from said operating portion so as to couple said lever walls with each other.

3. A lever fitting-type connector according to claim 1, wherein, an electric wire housing space for accommodating the electric wires is formed between said electric wire protecting wall of said lever and said connector body when said male connector is completely fitted into said hood portion of said female connector section,.

4. A lever fitting-type connector according to claim 1, wherein said connector further comprising:

provisional fixing means for provisionally fixing said connector body at a position where said connector body is fitted to said hood portion before a completely fitting condition and, under the provisional fixing state, said electric wires are accommodated between said electric wire protecting wall and said connector body.

5. A lever fitting-type connector according to claim 4, wherein said provisional fixing means includes a provisional fixing protrusion which protrudes from said connector body and a provisional fixing hole which is formed in said lever body, and said provisional fixing protrusion is to be inserted into and engagingly held to said provisional fixing hole.

* * * * *